US006882277B2

(12) United States Patent
Kolton et al.

(10) Patent No.: US 6,882,277 B2
(45) Date of Patent: Apr. 19, 2005

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/087,628

(22) Filed: Mar. 1, 2002

(65) Prior Publication Data

US 2003/0164768 A1 Sep. 4, 2003

(51) Int. Cl.[7] ..... G08B 13/14

(52) U.S. Cl. ..... 340/572.8; 340/572.9; 235/487

(58) Field of Search ..... 340/572.8, 572.6, 340/572.9; 24/3.1, 3.13, 66.1, 222, 303; 235/487, 490, 491, 492, 493, 495

(56) References Cited

U.S. PATENT DOCUMENTS 3,756,200 A * 9/1973 Ohlhausen ..... 119/655
4,026,290 A * 5/1977 Brooker et al. ..... 604/290
4,510,490 A * 4/1985 Anderson et al. ..... 340/572.1
5,799,425 A * 9/1998 Merser et al. ..... 40/299.01
6,218,944 B1 * 4/2001 Kiesewetter et al. ..... 340/572.6
6,304,184 B1 * 10/2001 Kolton et al. ..... 340/572.8
6,342,838 B1 * 1/2002 Kolton et al. ..... 340/572.1
6,433,686 B1 * 8/2002 Feibelman ..... 340/572.8

* cited by examiner

*Primary Examiner*—Benjamin C. Lee
(74) *Attorney, Agent, or Firm*—Hoffmann & Baron, LLP

(57) ABSTRACT

An EAS marker assembly comprising a housing defining an interior cavity and an EAS marker contained in the housing interior cavity, the housing defining first and second tabs extending outwardly of the housing, each of the first and second tabs defining an aperture extending therethrough. The EAS marker assembly is assembled with an article of manufacture defining first and second apertures extending therethrough, the EAS marker assembly being arranged in combination with the article of manufacture such that the apertures of the first and second tabs are aligned with the first and second apertures of the article of manufacture and a joinder device extending through the apertures of the first and second tabs and the first and second apertures of the article of manufacture and securing the EAS marker assembly to the article of manufacture.

9 Claims, 4 Drawing Sheets

10
10a
10b 10
20
10a
10b 10
28
20
24
IV
IV
22
18
26

10
14
16
10b
10a
12

ELECTRONIC ARTICLE SURVEILLANCE MARKER ASSEMBLY

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

In commonly-assigned U.S. Pat. No. 5,998,462, a garment hanger is disclosed which overcomes the foregoing disadvantages. Therein, a garment hanger is set forth which is comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS marker.

SUMMARY OF THE INVENTION

The present invention has as its primary object the provision of EAS marker assemblies having the benefit of the '462 patent and applicability to articles of manufacture other than hangers.

In attaining this and other objects, the invention provides an EAS marker assembly comprising a housing defining an interior cavity and an EAS marker contained in the housing interior cavity, the housing defining first and second tabs extending outwardly of the housing, each of the first and second tabs defining an aperture extending therethrough. The housing is preferably comprised of first and second housing members in mutually confronting relation, the first housing member defining the interior cavity, the first and second housing members each defining the first and second tabs extending outwardly thereof The invention further provides, in combination, an EAS marker assembly comprising a housing defining an interior cavity and an EAS marker contained in the housing interior cavity, the housing defining first and second tabs extending outwardly of the housing, each of the first and second tabs defining an aperture extending therethrough, an article of manufacture defining first and second apertures extending therethrough, the EAS marker assembly being arranged in combination with the article of manufacture such that the apertures of the first and second tabs are aligned with the first and second apertures of the article of manufacture and a locking device extends through the apertures of the first and second tabs and the first and second apertures of the article of manufacture and secures the EAS marker assembly to the article of manufacture.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figures 1, 2, 3, 4:
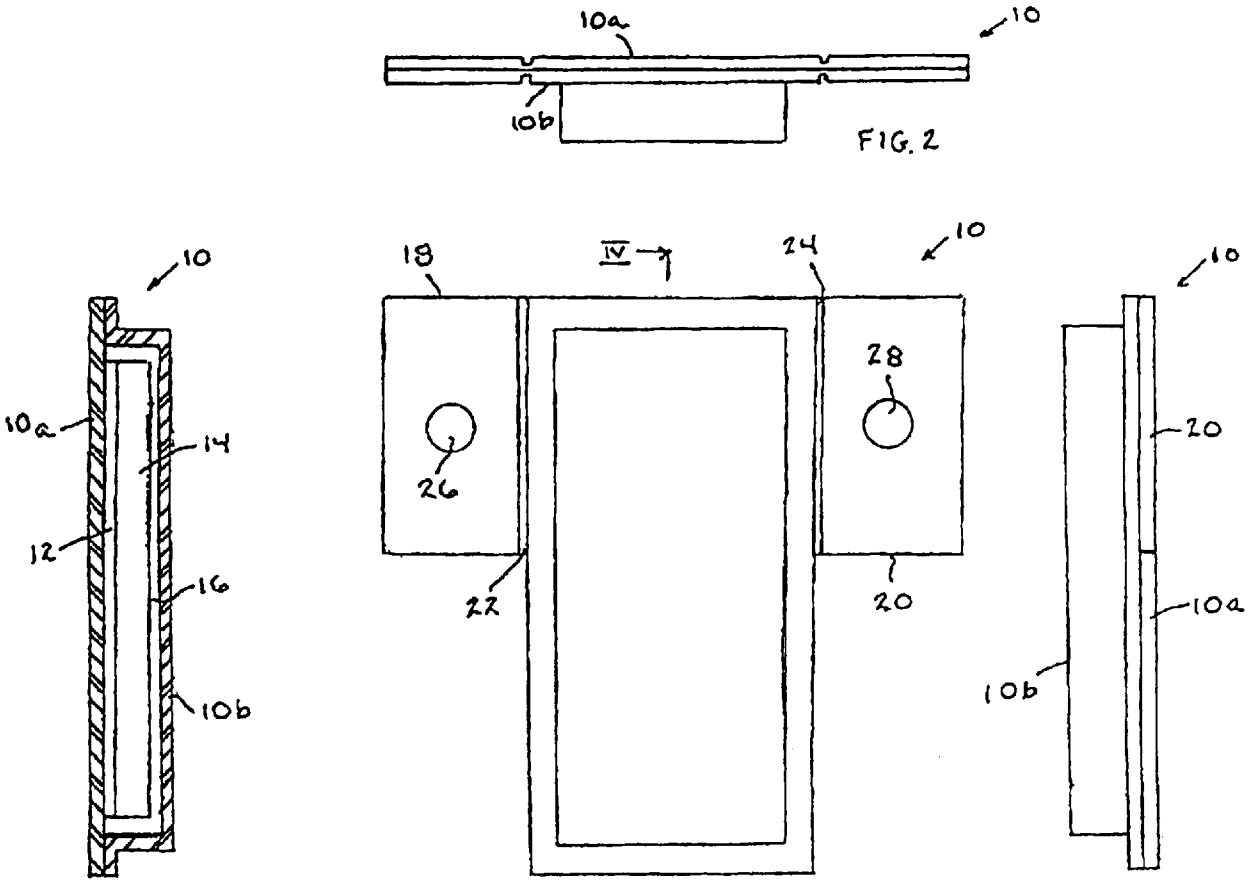
FIG. 1 is a front elevation of an EAS marker assembly in accordance with the invention.
FIG. 2 is top plan view of the FIG. 1 EAS marker assembly.
FIG. 3 is a right side elevation of the FIG. 1 EAS marker assembly.
FIG. 4 is a sectional view as would be seen from plane IV—IV of FIG. 1.

Turning to FIGS. 1–4, EAS marker housing 10 of the invention is preferably comprised of housing members 10*a* and 10*b*, each formed of molded plastic.

Housing member 10*a* has a first part having dual-sided adhesive layer 12 thereon and EAS marker 14 is disposed on and secured to adhesive layer 12.

Housing member 10*b* has a first part defining compartment 16, which is configured in dimensions to overly EAS marker 14.

Housing 10 includes tabs 18 and 20 hinged thereto by hinge parts 22 and 24. The tabs and hinges are formed by respective facing parts of housing members 10*a* and 10*b*. Tabs 18 and 20 include respective apertures 26 and 28, extending through housing 10. Housing members 10*a* and 10*b* are mutually secured as by perimetric heat-sealing.

Figure 5:
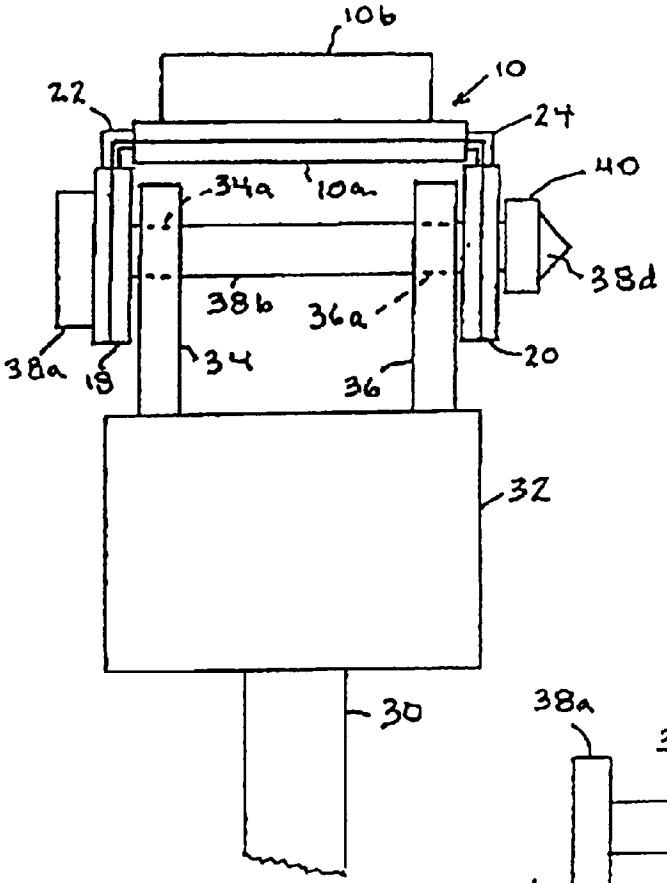
FIG. 5 is a front elevation of the EAS marker assembly of FIGS. 1–4 in assembly with a plug of an electrical cable.
Figure 6:
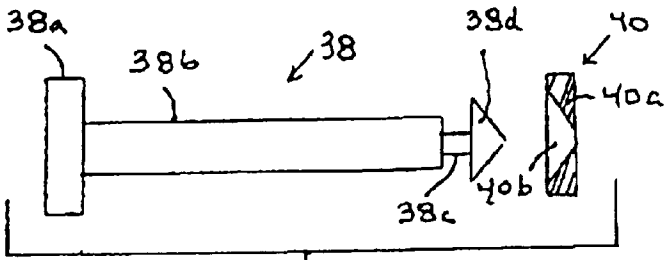
FIG. 6 shows joinder and locking devices of the assembly of FIG. 5, shown separately therefrom, with the locking device shown centrally sectioned.

Turning to FIGS. 5 and 6, the EAS marker assembly of FIGS. 1–4 is shown in assembly with an article of manufacture, namely, an electrical cable assembly having cable 30, plug 32 and connecting prongs 34 and 36 extending outwardly of plug 28. As a standard, prongs 34 and 36 define apertures therethrough, indicated in phantom in FIG. 5 by reference numerals 34*a* and 36*a*.

Joinder device 38 has an abutment part 38*a*, a first shaft part 38*b*, a second, reduced diameter shaft part 38*c* and a wedge-shaped end part 38*d*.

In reaching the assembly of FIG. 5, tabs 18 and 20 of housing 10 are folded downwardly and tab apertures 26 and 28 are placed respectively in registry with prong apertures 34*a* and 36*a*. Joinder device 38 is now inserted, end part 38*d* leading, into tab aperture 26, through prong aperture 34*a*, through prong aperture 36*a* and through tab aperture 28.

As alluded to above, joinder device 38 may effect self-locking of the assembly of the EAS member housing and the article of manufacture. In this case, the length of joinder device parts 38*b* and 38*c* is equal to the distance between the folded tabs. End part 38*d* compresses upon insertion of joinder device 38 and thereafter expands to abut on outer surface of tab 20 to lock the assembly.

Alternatively, the invention contemplates use of a locking device separate from joinder device 38, indicated by reference numeral 40 and comprising a cylinder 40*a* defining a tapered opening 40*b* extending therethrough. As is seen in FIG. 5, end part 38*d*, compressed on passing through locking device 40, abuts outer surface of locking device 40 to secure the assembly.

Figure 7:
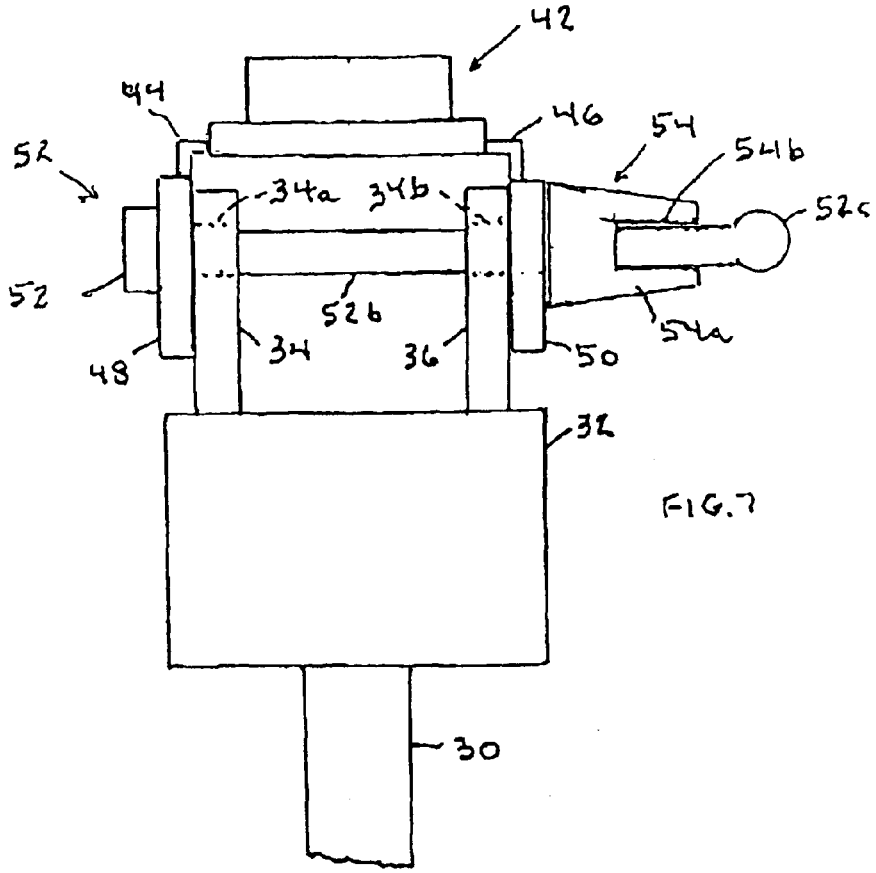
FIG. 7 is a front elevation of another EAS marker assembly in accordance with the invention in assembly with a plug of an electrical cable, wherein a locking device is disposed in association with a joinder member facilitating disassembly of the EAS marker assembly from the joint assembly of EAS marker assembly and plug.
Figure 9:
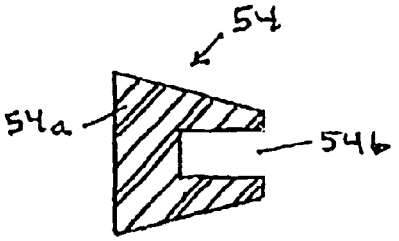
FIG. 9 is a sectional view of the locking device of FIG. 7 as would be seen from plane IX—IX of FIG. 8.
Figure 8:
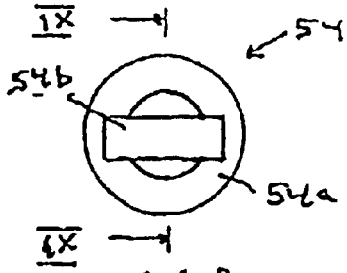
FIG. 8 is a right side elevation of the locking device of FIG. 7.

Turning to FIGS. 7–9, a further embodiment 42 of an EAS marker assembly of the invention is depicted. Assembly 42 contains an EAS marker therein and has hinges 44 and 46 associated therewith supporting tabs 48 and 50, having apertures (not shown) extending therethrough akin to apertures 26 and 28 of the first embodiment. The electrical cable assembly, plug and prongs are identified by the same reference numerals as in FIG. 5 above.

The assembly of FIGS. 7–9 differs from that of FIGS. 5 and 6 in respect of joinder device 52, which has an abutment part 52*a*, a shaft part 52*b*, and a bulb-shaped end part 52*c*. Diverse also is locking device 54, which is defined by a conical body part 54*a* and a cross-recess 54*b*. Parts of conical body parts adjacent cross-recess 54*b* are deflectable upon insertion of joinder device 52 into locking device 54, whereupon end part 52*c* abuts the rightward end of locking device 54.

However, as is shown in FIG. 7, the clearances as between the tabs and prongs (see FIG. 5) are minimized, as by movement of locking device 54 leftwardly in FIG. 7, thereby exposing shaft part 52*b* leftwardly of end part 52*c* for cutting by a suitable cutting tool (not shown), permitting disassembly of EAS marker assembly 42 from prongs 34 and 36.

Figure 11:
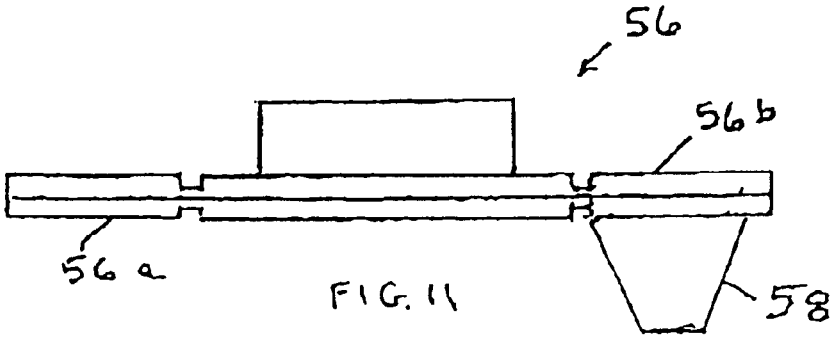
FIG. 11 is a top plan view of FIG. 10.
Figure 10:
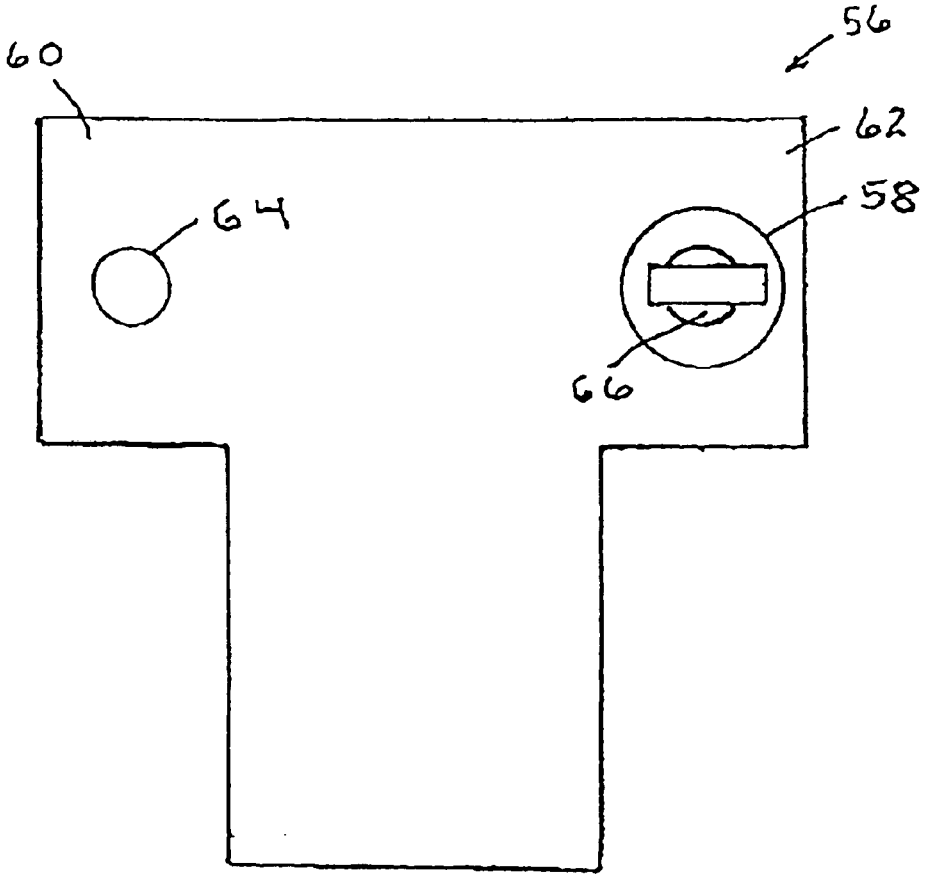
FIG. 10 is a rear side elevation of a further EAS assembly in accordance with the invention.

Turning to FIGS. 10 and 11, EAS marker housing 56 of the invention is preferably comprised of housing members 56*a* and 56*b*, each formed of molded plastic.

Housing member 56*b* is configured as housing member 10*a* of FIGS. 1–4, i.e., having a dual-sided adhesive layer thereon and an EAS marker disposed on and secured to the adhesive layer.

Housing member 56*a* is configured as housing member 10*b* of FIGS. 1–4, i.e., having a first part defining a compartment, which is configured in dimensions to overly the EAS marker. Housing member 56*a* differs from housing member 10*b* in having locking device 58 formed integrally with one of tabs 60 and 62, e.g., tab 62. Tabs 60 and 62 have respective apertures 64 and 66 extending therethrough, aperture 66 also extending through locking device 58.

EAS marker housing 56 has the advantage of needing only a joinder device, i.e., in providing a two-piece unit rather than the three-piece arrangement of FIGS. 7–9.

Various changes to the particularly disclosed embodiments and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. An EAS marker assembly comprising a housing defining an interior cavity and an EAS marker contained in said housing interior cavity, said housing defining first and second tabs extending outwardly of first and second different sides of said housing, each of said first and second tabs defining an aperture extending therethrough, wherein said housing is comprised of first and second housing members in mutually confronting relation, said first housing member defining said interior cavity, said first and second housing members each defining said first and second tabs extending outwardly thereof.

2. The EAS marker assembly claimed in claim 1, wherein said first and second tabs extend to respective free tab ends, said housing defines hinge sections at ends of said first and second tabs opposite said free ends thereof.

3. The EAS marker assembly claimed in claim 1, further including a joinder device having a shaft portion of diameter equal to or less than a diameter of said tab apertures.

4. The EAS marker assembly claimed in claim 3, further including a locking device securable to said joinder device.

5. In combination:

an EAS marker assembly comprising a housing defining an interior cavity and an EAS marker contained in said housing interior cavity, said housing defining first and second tabs extending outwardly of first and second different sides of said housing, each of said first and second tabs defining an aperture extending therethrough;

an article of manufacture defining first and second apertures extending therethrough, said EAS marker assembly being arranged in combination with said EAS marker assembly such that said apertures of said first and second tabs are aligned with said first and second apertures of said article of manufacture; and a joinder device extending through said apertures of said first and second tabs and said first and second apertures of said article of manufacture and securing said EAS marker assembly to said article of manufacture.

6. The invention claimed in claim 5, further including a locking device securable to said joinder device.

7. The invention claimed in claim 5, wherein said article of manufacture is an electrical cable assembly, said first and second apertures of said article of manufacture comprising respective apertures in prongs of a plug of said electrical cable assembly.

8. The invention claimed in claim 7, further including a locking device securable to said joinder device.

9. In combination:

an EAS marker assembly comprising a housing defining an interior cavity and an EAS marker contained in said housing interior cavity, said housing defining first and second tabs extending outwardly of first and second different sides of said housing, each of said first and second tabs defining an aperture extending therethrough and a locking device secured with said first tab;

an article of manufacture defining first and second apertures extending therethrough, said EAS marker assembly being arranged in combination with said EAS marker assembly such that said apertures of said first and second tabs are aligned with said first and second apertures of said article of manufacture; and a joinder device extending through said apertures of said first and second tabs and said first and second apertures of said article of manufacture and said locking device for securing said EAS marker assembly to said article of manufacture.

* * * * *